US007688278B2

(12) United States Patent
Frenkel

(10) Patent No.: US 7,688,278 B2
(45) Date of Patent: Mar. 30, 2010

(54) BALLISTIC PROTECTIVE RADOME

(76) Inventor: Avraham Frenkel, 1/9 Hamagenim St, Kiriat Bialik (IL) 27206

( * ) Notice: Subject to any disclaimer, the term of this patent is extended or adjusted under 35 U.S.C. 154(b) by 666 days.

(21) Appl. No.: 11/571,298

(22) PCT Filed: Jul. 20, 2005

(86) PCT No.: PCT/IL2005/000771

§ 371 (c)(1),
(2), (4) Date: Dec. 27, 2006

(87) PCT Pub. No.: WO2006/011133

PCT Pub. Date: Feb. 2, 2006

(65) Prior Publication Data

US 2009/0167628 A1 Jul. 2, 2009

(30) Foreign Application Priority Data

Jul. 25, 2004 (IL) ..... 163183

(51) Int. Cl.
*H01Q 1/42* (2006.01)

(52) U.S. Cl. ..... 343/872; 343/909

(58) Field of Classification Search ..... 343/872, 343/909

See application file for complete search history.

(56) References Cited

U.S. PATENT DOCUMENTS 5,140,338 A 8/1992 Schmier et al.
5,182,155 A * 1/1993 Roe ..... 428/116
5,820,077 A * 10/1998 Sutliff et al. ..... 244/119
6,112,635 A 9/2000 Cohen et al.
6,476,771 B1 11/2002 McKinzie, III
2003/0034933 A1 2/2003 Frenkel
2005/0078036 A1 * 4/2005 Koch ..... 343/702

FOREIGN PATENT DOCUMENTS

EP 1 363 101 A 11/2003

* cited by examiner

*Primary Examiner*—HoangAnh T Le

(57) ABSTRACT

A ballistic protective radome (10) consisting of substantially longitudinal layer members (14) firmly and densely packed in a uniform array, forming a main protective layer (12). The layer members (14) are mutually spaced apart and electrically isolated such that a continuous gap (18) is formed in the main protective layer (12). The layer members (14) are made of mechanical energy absorbing and high tensile strength materials such as ceramics, metallic alloys nanoparticulate ceramics and nanoparticulate metallic alloys. The surface of the layer members is electrically conducting, optionally by plating with a layer of highly electrically conducting materials having a width of a few skin depths. Optionally a dielectric layer (16) is attached to at least one surface border of the main protective layer for promoting the ballistic features of the radome and providing for impedance matching. A method for tuning the operational frequency of the radome is provided by grouping the layer members in pairs (12A-12C) of layer members having collinear main axes. Optionally discs (26D-26F) having electrically conducting surface are inserted into the gaps between the paired layer members.

13 Claims, 4 Drawing Sheets

BALLISTIC PROTECTIVE RADOME

TECHNICAL FIELD OF THE INVENTION

The present invention relates generally to the protection of microwave and millimeter-waves antennae, and more specifically to transparent protective radomes. It also relates to armored plates protecting sensitive equipment from projectiles or other ballistic fragments.

BACKGROUND OF THE INVENTION

Radome builders often use impact-resistant laminates for providing ballistic protection to microwave antennae. Typically, laminates made of aramid fibers (Kevlar®) and polyethylene fibers (Spectra®, HDPE) are utilized. International application WO 03/031901 discloses a nano-denier fibrous woven sheet that could be used for ballistic impact-resistance radome design. The impact-resistant laminates or woven sheets combined with structural layers of honeycomb or solid foam cores can form basically an almost transparent radome suited to a specific band of frequencies. U.S. Pat. No. 5,182,155 discloses a composite radome structure based on alternate layers of Spectra® and dielectric honeycomb.

U.S. Pat. No. 4,570,166, discloses a radome structure made of a perforated metal wall, in which each of the holes is filled with a dielectric plug, providing improved ballistic protection. Electromagnetic waves propagate through the perforations in a thick metal plate if the apertures are large enough—such that the waveguide generated by the single hole is above its cutoff frequency.

Such a metal plate could be made of ballistic resistant steel, and the plugs could be made of a ballistic resistant ceramic material (e.g. silicon nitride) together conferring low microwave loss characteristics. A main drawback associated with this approach is the high density of the steel structure that leads to excessive weight.

Another approach known in the art consists of homogeneous ceramic radomes. Such radomes are commonly used in high-temperature applications such as in high-speed missiles. However, proper manufacturing of such radomes is rather costly. Impact resistant ceramic materials are usually very hard, leading to difficulties in the mechanical processing of the radome. Moreover, the tangent-loss of these ceramic materials is sensitive to the details of the sintering process, so the process parameters need to be carefully controlled over the whole volume of the radome.

It is a well known fact that a dense array of small ceramic units embedded in a suitable dielectric matrix can serve as an effective ballistic shield. U.S. Pat. No. 6,112,635 discloses a composite armor plate made of a single layer of tightly packed touching ceramic cylinders bound together by a solidified material. EP 1,363,101A1 discloses a ballistic armor comprising an array of non-touching ceramic units packed together by a non-ceramic material. However, both patents U.S. Pat. No. 6,112,635, and EP 1,363,101A1 do not relate to antenna radomes, and therefore are not applicable to microwaves or millimeter waves.

DETAILED DESCRIPTION OF THE INVENTION

Figure 1:
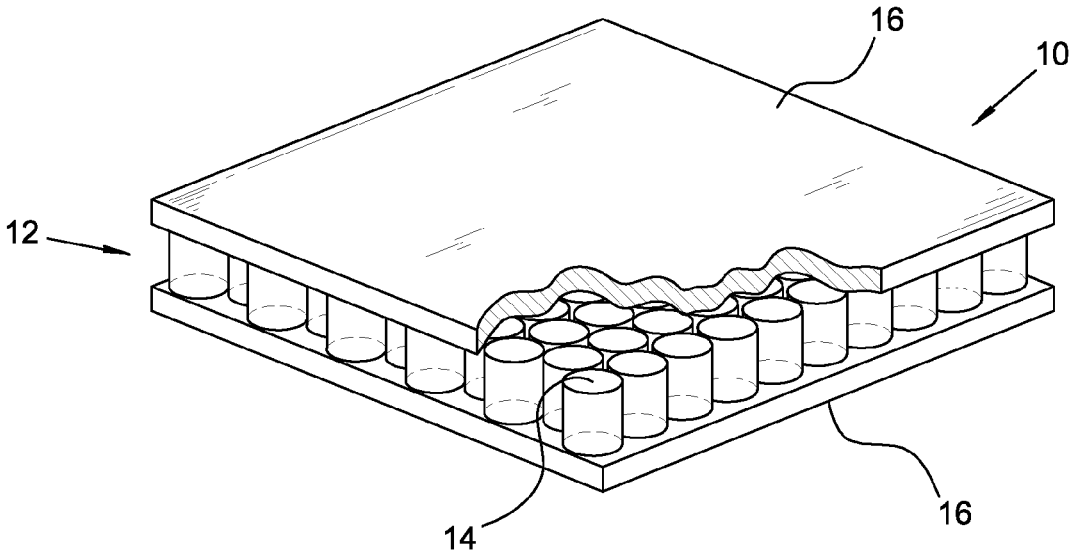
FIG. 1 is an isometric view showing a segment of the radome embodying the present invention, including one main protective layer composed of cylindrical layer members and two dielectric layers.
Figure 2:
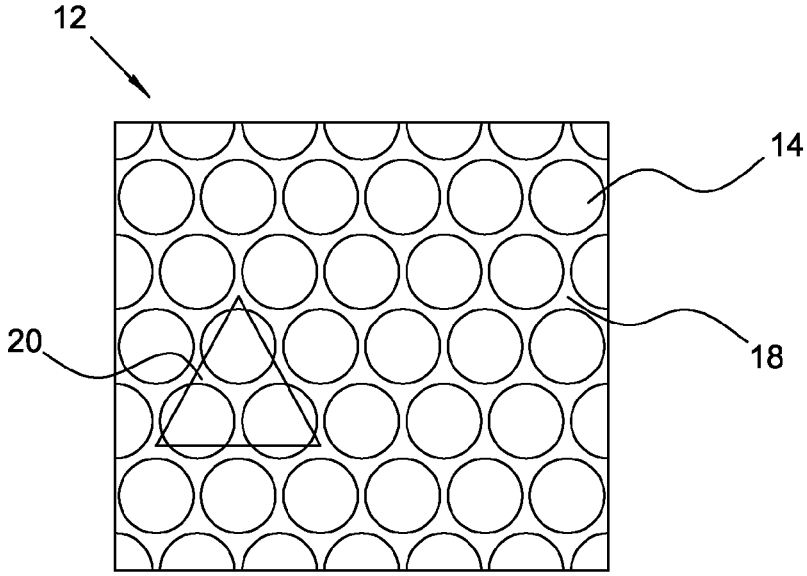
FIG. 2 is a front sectional view of a segment of the main protective layer showing a periodic array of triangular lattice of non-touching cylindrical layer members.

In FIGS. 1 and 2 to which reference is first made, an isometric view and a front sectional view of a segment of a radome wall according to a preferred embodiment of the present invention is shown respectively. For the sake of simplicity same parts in different figures are hereinafter indicated by same numerals, unless otherwise specified. In FIG. 1 a segment of a radome wall 10 is shown composed of a main protective layer 12 and two dielectric layers 16 attached to both surfaces of the main protective layer. The main protective layer 12 consists of mutually spaced apart and tightly packed cylindrical layer members 14. As can be seen in FIG. 2, the layer members 14 are embedded in a dielectric matrix that holds together all layer members, forming periodic array of triangular lattice 20.

Dielectric layers 16 are typically made of Kevlar® or polyethylene (HDPE) and may be attached in front of the main protective layer facing the ballistic threat, and in the rear of the main protective layer. Although the dielectric layers are optional, they can improve the ballistic performances of the radome, stop fragments, and tune the radome for maximal bandwidth in frequency.

Layer members 14 can be made of any material that has the proper mechanical tensile strength to provide the protection for the antennae. According to the present invention, a ballistic protection for the antennae is attained with layer members made of hard material such as nanoparticulate materials, ceramics and metal alloys designed to withstand projectiles of specified mass and velocity. Many of these materials are not suitable for microwaves or millimeter-waves applications because of their dielectric or conductive losses. Therefore, such layer members are plated with highly electrically conducting materials. The thickness of the conducting layer is larger than two skin-depths, in order to reduce conductive losses at these radiation frequencies. Therefore a layer member of the invention has an electrically conducting surface. Ceramics is considered preferable over hard metallic alloys, because of the weight versus ballistic protection ratio. Solid steel units can also be used although steel might not be the most efficient from the ballistic point of view. However steel is an equivalently valid option from the electromagnetic point of view. Any other suitable material simultaneously satisfying the mechanical and electromagnetic properties required is applicable.

The layer members are mutually spaced apart and therefore electrically isolated. As shown in the figure, gap 18, continuous throughout the layer, which is filled with the dielectric matrix, is formed within the main protective layer. Since the electric field of the electromagnetic radiation is transversely polarized, there is no cutoff effect that prevents from the radiation to propagate through the continuous gap. However, the low effective impedance of the front and rear border surfaces of the main protective layer (most of the area of these surfaces is conducting), usually leads to low transmittance because of the large contrast with the vacuum impedance.

To improve the transmittance of the radome, the present invention utilizes a resonance effect. Frequency selective surfaces made of resonant slots in a thin conducting surface, are known in the art and demonstrate that a resonance can enhance the transmission through a conducting surface, up to complete transmission at the resonant frequencies. The present invention is based on a different resonance mechanism. Namely, the height of the layer members (or the length of the main axis of the longitudinal layer members which is also the thickness of the main protective layer) closely obeys the resonance condition given by the equation: $h=(2n-1)\lambda_g/2$, where h is the width of the main protective layer, n is an integer number (n=1,2,3, . . . ) and $\lambda_g$ is the wavelength of the radiation propagated in the dielectric matrix.

The additional dielectric layers 16 serve as impedance transformers, such that the radome allows almost full transmission within a band of frequencies. Typical frequency bandwidth for normal incidence at 0.5 dB transmission-loss may vary from 5% to 15% of the resonance frequency value, as is described infra.

Figure 3A:
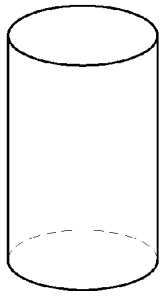
FIG. 3A is a schematic presentation of a cylindrical layer member of the invention.
Figure 3B:
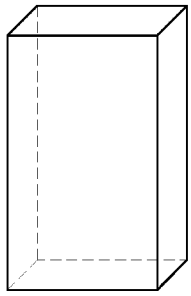
FIG. 3B is a schematic presentation of a square prismatic layer member of the invention.
Figure 3C:
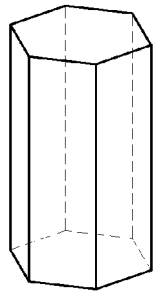
FIG. 3C is a schematic presentation of a hexagonal prismatic layer member of the invention shaped as a hexagonal.
Figure 3D:
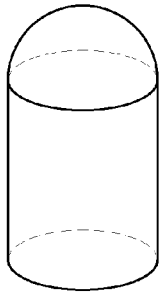
FIG. 3D is a schematic presentation of a cylindrical layer member of the invention capped at one end.
Figure 3E:
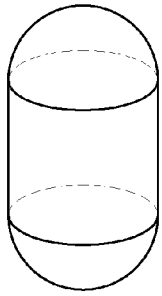
FIG. 3E is a schematic presentation of a cylindrical layer member of the invention capped at both ends.
Figure 3F:
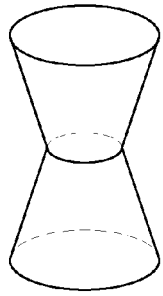
FIG. 3F is a schematic presentation of a layer member of the invention shaped as dual truncated cones attached to each other.

The different shapes of the layer member as are shown in FIGS. 3A-3F, convey specific transmittance value to the main protective layer and determine the degree of ballistic protection provided. The radome of the present invention allows for any longitudinal bodies, including but not limited to the geometrical shapes displayed in FIGS. 3B-3F. In addition to the cylindrical shape employed in a preferred embodiment and described in FIG. 3A, a square prism element as shown in FIG. 3B, forms periodic array expressed as a square lattice. A hexagonal prisms as shown in FIG. 3C, forms a triangular lattice. Unilaterally sphere—capped cylinder as shown in FIG. 3D or a bilaterally sphere—capped cylinder, as shown FIG. 3E are other possible embodiments, beneficial from the ballistic point of view. Moreover, the cross-section itself could vary along the main axis of the layer member body, as shown in FIG. 3F.

The geometrical shape of the layer member and the spacing between adjacent members are basically chosen on ballistic grounds. However the operational frequency of the radome is also effected by the width of the continuous gap and shape of the layer members, and therefore limits the scope of their ballistic efficiency.

At frequencies higher than C band, a radome with a single main protective layer may not provide sufficient ballistic protection. The present invention allows to achieve the necessary ballistic protection with layer members consistent with the resonance equation $h=(2n-1)\lambda_g/2$ for higher n values (n>1). However, the frequency bandwidth associated with higher resonance (n>1) is narrower than the bandwidth of the dominant resonance (n=1). Alternatively, the present invention allows for a multiple main protective layer structure with suitable dielectric spacers to achieve higher level of ballistic protection, while maintaining a wide frequency bandwidth. The width of the dielectric spacer is not larger than half the wavelength of the radiation propagating in the continuous gap.

Figure 4:
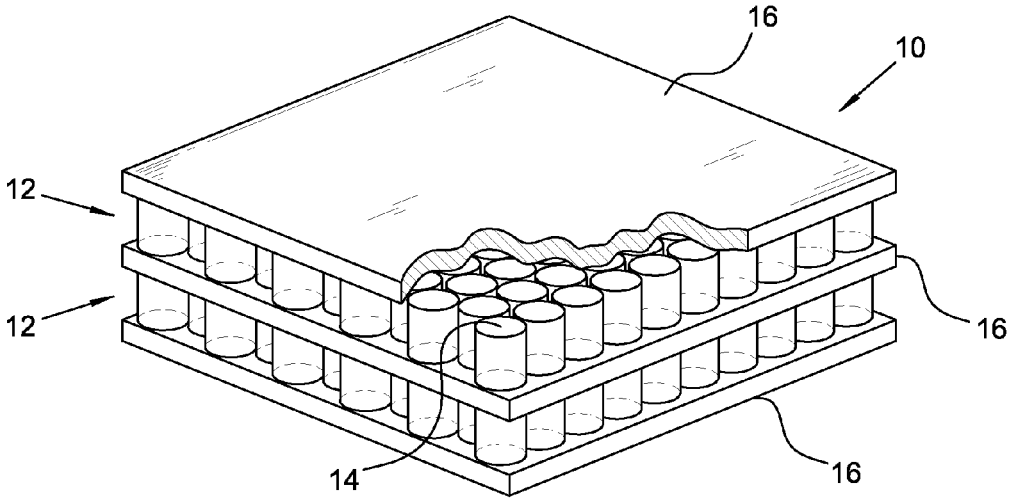
FIG. 4 is an isometric view showing a segment of a radome embodying the present invention, suitable for X band frequencies.

In FIG. 4 to which reference is now made, another preferred embodiment of the present invention is shown, suitable for radiation frequency at the X band. A square radome wall 10 of this preferred embodiment is shown composed of two main protective layers 12, each consisting of an array of cylindrical layer members 14, attached to both faces of dielectric layer 16. Two additional dielectric layers 16 are attached, one in the front and the other in the rear of the surfaces of the double main layer structure.

In another embodiment of the present invention a thin uniform dielectric layer encapsulates the layer members which as is described above have an electrically conducting surface. The layer members can be tightly and firmly packed before being immersed in the dielectric matrix while maintaining the dimensions and shape of the continuous gap. In accordance with EP 1,363,101A1, the contents of which are incorporated herein by reference, the ballistic properties are not effected from the small additional spacing between layer members.

The radome providing ballistic protection in accordance with the present invention can be fabricated to assume any surface curvature. This is achieved by means of a proper mold and also by utilizing layer members having different shapes. In regions of a relatively high curvature the distributions of the layer members are allowed to deviate somewhat from a perfect periodicity. However there are limitations to such a deviation, the extent of deviation being related to the operational frequency and bandwidth. Namely, regions in which deviations from the average distance between the centers of adjacent members occur should extend to no more than a few wavelengths in dimensions. The total area of such regions should be smaller than a few percents of the total area of the radome as well.

Typically, the electromagnetic features of the materials used in the fabrication of a radome according to the invention are not accurate enough. It is also known to those familiar in the art that the dimensions and some of the electromagnetic features of the layer members may change during the manufacturing process. Therefore it can be expected that either during the development process of a radome or during the preliminary production stages, the operational frequency of the radome is shifted from its desired value. Alternatively, a given radome of the present invention having a specific operational frequency has to be redesigned in order to have an operational frequency which is slightly different from its original value. The method according to the present invention provides for tuning the operational frequency of a radome by utilizing the aforementioned layer members to form of main protective layer having a different configuration as is hereinafter described.

Figure 5A:
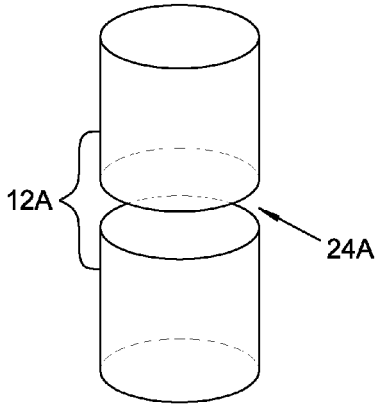
FIG. 5A is a schematic presentation of a configuration of a main protective layer consisting of pairs of cylindrical layer members.
Figure 5B:
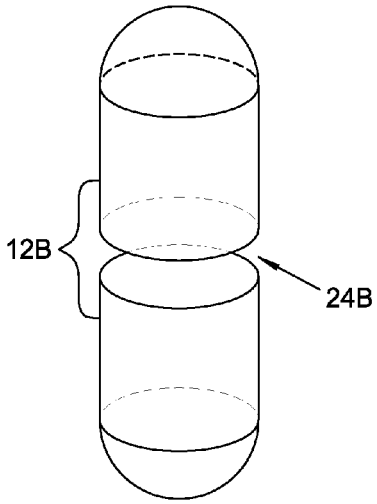
FIG. 5B is a schematic presentation of a configuration of a main protective layer consisting of pairs of one sided capped cylindrical layer members.
Figure 5C:
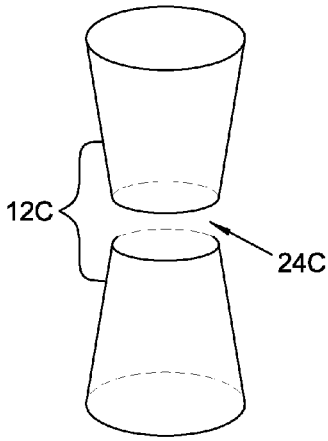
FIG. 5C is a schematic presentation of a configuration of a main protective layer consisting of pairs of layer members shaped as truncated cones.

Reference is now made to FIGS. 5A-5C in which three exemplary configurations of a pair of layer members of the main protective layer according to another embodiment are shown. The main protective layers in these examples include a planar distribution of a plurality of pairs of layer members. The pair members are placed coaxially one on top of the other, each one being a mirror image of the other. They are spaced apart by a predetermined gap and their main axes are normal to the main protective layer. Such a configuration is referred to hereinafter as a paired layer members configuration (PLMC), which is different than the single layer member configuration of the main protective layer described hereinabove.

In FIG. 5A two cylinders 12A of a pair of layer members are shown, spaced apart by gap 24A. In FIG. 5B two one sided capped cylinders 12B of a pair of one sided capped cylinders are shown, each being a mirror image of the other, separated by a gap 24B. Similarly, in FIG. 5C the pair of layer members are truncated cones 12C separated by a gap 24C. The gaps between each such layer members of a pair modify the geometry of the aforementioned continuous gap and therefore effect its resonance frequency. However the width of the protective layer that equals the sum of the heights of two layer members of a pair and the width of the gap between them has to closely obey the aforementioned resonant condition. Namely this width has to closely equal the value of w given by the equation: w32 $(2n-1)\lambda_g/2$, where $\lambda_g$ is the wavelength of the electromagnetic radiation propagating in the dielectric material filling the continuous gap and n is an integer number. However the height of a layer member also impacts the ballistic features of the radome. Therefore within practical limits the wider the gaps are the resulted operational frequency is lower as is described in example 2 below.

Figure 5D:
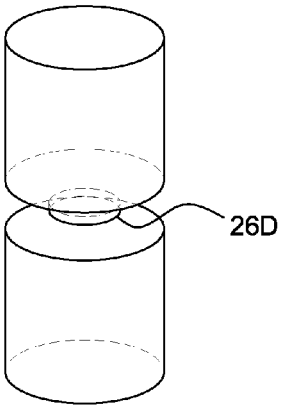
FIG. 5D is a schematic presentation of a configuration of a main protective layer of FIG. 5A according to a preferred embodiment of the invention.
Figure 5E:
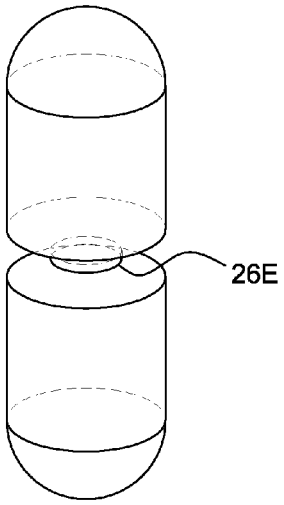
FIG. 5E is a schematic presentation of a configuration of a main protective layer of FIG. 5B according to a preferred embodiment of the invention.
Figure 5F:
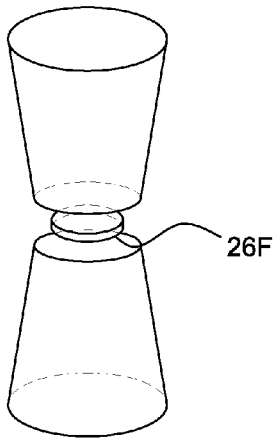
FIG. 5F is a schematic presentation of a configuration of a main protective layer of FIG. 5C according to a preferred embodiment of the invention.

Reference is now made to FIGS. 5D-5F in which same exemplary PLMCs according to another preferred embodiment of the present invention are schematically shown. As is shown in FIGS. 5D-5F metallic discs 26D, 26E, and 26F are disposed in the middle of the gaps located between the two members of each pair, coaxially with the pair members. Discs as are either made of same material or a different material of which the layer members are made of. The discs are also similarly plated with same electrically conducting material. The discs may be either electrically isolated or in contact with one or both paired layer members. Therefore by varying the width of the gap between layer members of a pair and or by changing the dimensions of the discs, the geometrical shape of the continuous gap is varied and the operational frequency of the radome is accordingly effected as is further described in example 2.

EXAMPLE 1

Figure 6:
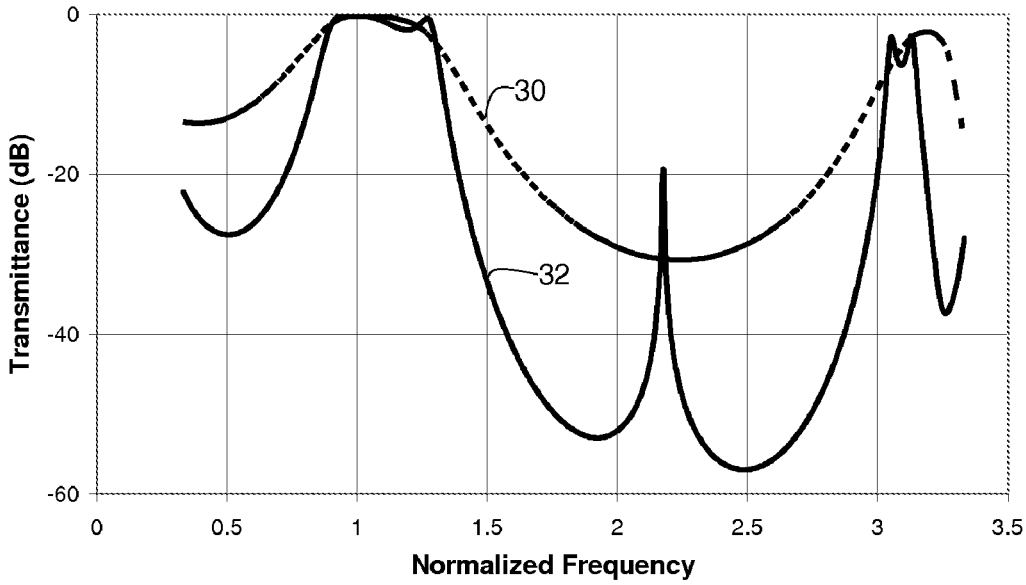
FIG. 6 is a graph showing the typical transmission coefficients of two embodiments of the radome providing ballistic protection. One curve is a typical transmission coefficient for a radome consisting of a single main protective layer, and the other curve is a typical transmission coefficient of a radome composed of two main protective layers with proper dielectric spacers.

Two different exemplary radomes implementing a single layer member configuration are built in accordance with two preferred embodiments of the present invention. One of these radomes implements the single main protective layer as is described in FIG. 1 and the other radome implementing a double main protective layer as is described in FIG. 4. The height of the layer members obeys the aforementioned resonant condition $h=\lambda_g/2$ for a specific resonance frequency. The constraints to the radome design dictated by the resonant effect of the continuous gap may be better explained by reference to FIG. 6. It shows typical plots of transmittance versus normalized operational frequency, measured in resonance frequency units, obtained for both radomes. The plot indicated by 30 represents the single layer configuration whereas the double layer configuration is represented by the plot indicated by 32. Both curves are normalized to have the same transmittance value at the resonance frequency.

EXAMPLE 2

Figure 7:
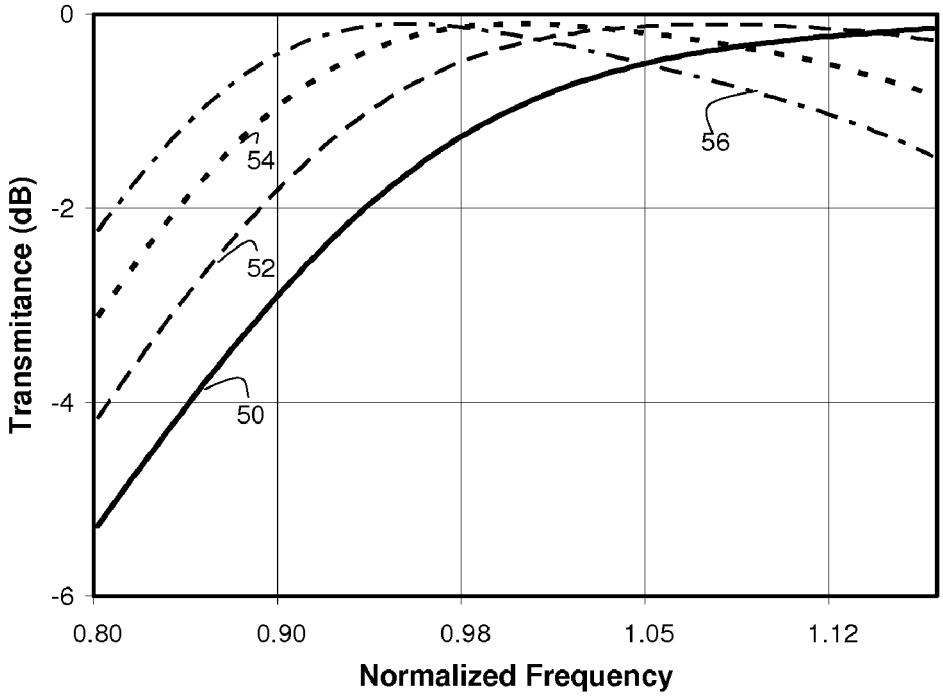
FIG. 7 is a graph of typical transmittance vs. normalized frequency of radomes having paired layer members configurations of the type shown in FIG. 6E, for different separation lengths between layer members of a pair.

Exemplary PLMC radomes employing one sided caped cylindrical layer members as is shown in FIG. 5E, to which reference is again made, are built in accordance with a preferred embodiment of the present invention. The height of the layer members is $h=0.18\,\lambda_g$, and the radius of the layer members is $0.127\,\lambda_g$. Tuning the operational frequency of such radomes is accomplished by changing either the width of the gap between the layer members of a pair and or by changing the dimensions of the disc. In this specific example, the height of the disc equals the width of the gap such that the disc is in contact with both pair members and the radius of the metal disc is $0.104\,\lambda_g$. A tuning capability of about 20% of the resonance frequency of the radome is demonstrated by reference to FIG. 7. Plots of the transmittance of various radomes versus normalized frequency measured in resonance frequency units are shown. These radomes vary with respect to the size of the respective gaps existing between the paired layer members. Curves 50, 52, 54 and 56 represent radomes having gap sizes of 0.144h, 0.180h, 0.216h and 0.252h respectively.

The invention claimed is:

1. A method for providing protection to microwave and millimeter wave antennae comprising disposing at least one densely and firmly packed array of substantially longitudinal layer members forming a uniform main protective layer such that the main axes of said substantially longitudinal layer members are normal to said main protective layer, wherein said layer members are mutually spaced apart forming a continuous gap in said array, and wherein at least a portion of a surface of said layer members is highly conductive of electrical current, and wherein said layer members are mutually electrically isolated, and wherein the width of said main protective layer is made to closely obey a resonance condition given by the equation:

$$w=(2n-1)\lambda_g/2, \text{ where}$$

w is the width of said main protective layer, n is an integer number and $\lambda_g$ is the wavelength of the radiation propagated in said continuous gap.

2. A method as in claim 1, further comprising coating said layer members with dielectric material.

3. A method as in claim 1, further comprising immersing said members in at least one dielectric matrix.

4. A method as in claim 1, further comprising attaching a dielectric layer to at least one surface of said main protective layer, wherein the width of said dielectric layer does not exceed one half of the wavelength of the radiation propagated in the dielectric layer.

5. A method as in claim 1, wherein said substantially longitudinal layer members are further paired in said main protective layer, and wherein each pair member has its main axis collinear with the other pair member, and wherein in each pair, the layer members are separated by a predefined gap.

6. A method as in claim 5, further comprising placing in said predefined gap a disc having an electrical conducting surface.

7. A method as in claim 6, wherein said disc is electrically isolated from at least one of said paired layer members.

8. A method as in any of claims 6-7, further comprising tuning the operational frequency of said main protective layer by changing the value of at least one item selected from a group consisting of the following items: the width of said gap between layer members of a pair, the radius of said disc, the height of said disc.

9. A radome for providing protection to microwave and millimeter wave antennae, comprising at least one main protective layer, wherein said main protective layer consists of a plurality of substantially longitudinal members forming a tightly packed array, and wherein the main axis of said substantially longitudinal members is normal to the surface of said main protective layer, and wherein said members are mutually spaced apart and electrically isolated forming a continuous gap in said array, and wherein at least a portion of said layer members has a highly electrically conducting surface, and wherein a width of said main protective layer closely obeys the resonant condition given by the equation $w=(2n-1)\lambda_g/2$, where w is the width of said main protective layer, n is an integer and $\lambda_g$ is the wavelength of the radiation propagated in said continuous gap.

10. A radome as in claim 9, further comprising a dielectric layer attached to at least one surface of said main protective layer.

11. A radome as in claim 10, wherein said dielectric layer is composed of materials selected from the group consisting of: aramid and high density poly-ethylene.

12. A radome as in claim 9, wherein said layer members are made of mechanical energy absorbing and high tensile strength materials, accommodated to withstand projectiles.

13. A radome as in claim 9, wherein said layer members are made of materials selected from the group consisting of: ceramics, metallic alloys, nanoparticulate ceramics and nanoparticulate metallic alloys.

* * * * *